US009063447B2

(12) United States Patent
Yu

(10) Patent No.: US 9,063,447 B2
(45) **Date of Patent: *Jun. 23, 2015**

(54) IMAGING MEMBERS HAVING A CROSS-LINKED ANTICURL BACK COATING

(71) Applicant: Xerox Corporation, Norwalk, CT (US)

(72) Inventor: Robert C. U. Yu, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/940,177

(22) Filed: Jul. 11, 2013

(65) Prior Publication Data

US 2015/0017579 A1 Jan. 15, 2015

(51) Int. Cl.

| | |
|---|---|
| ***G03G 5/10*** | (2006.01) |
| ***G03G 5/14*** | (2006.01) |
| ***G03G 5/05*** | (2006.01) |

(52) U.S. Cl.

CPC ..... *G03G 5/142* (2013.01); *Y10T 428/265* (2015.01); *Y10T 428/263* (2015.01); *G03G 5/10* (2013.01); *G03G 5/0517* (2013.01)

(58) Field of Classification Search

CPC ..... G03G 5/10
USPC ..... 430/56, 69, 930; 399/159
See application file for complete search history.

(56) References Cited

U.S. PATENT DOCUMENTS

| | | | | |
|---|---|---|---|---|
| 3,121,006 | A | 2/1964 | Middleton et al. | |
| 4,265,990 | A | 5/1981 | Stolka et al. | |
| 4,286,033 | A | 8/1981 | Neyhart et al. | |
| 4,291,110 | A | 9/1981 | Lee et al. | |
| 4,338,387 | A | 7/1982 | Hewitt et al. | |
| 4,464,450 | A | 8/1984 | Teuscher et al. | |
| 4,587,189 | A | 5/1986 | Hor et al. | |
| 4,664,995 | A | 5/1987 | Horgan et al. | |
| 4,921,773 | A | 5/1990 | Melnyk et al. | |
| 5,069,993 | A | 12/1991 | Robinette et al. | |
| 5,153,094 | A | 10/1992 | Kazmaier et al. | |
| 5,166,339 | A | 11/1992 | Duff et al. | |
| 5,189,155 | A | 2/1993 | Mayo | |
| 5,189,156 | A | 2/1993 | Mayo et al. | |
| 5,382,486 | A | 1/1995 | Yu et al. | |
| 5,756,245 | A | 5/1998 | Esteghamatian et al. | |
| 6,197,462 | B1 * | 3/2001 | Yanus et al. | 430/56 |
| 6,261,730 | B1 * | 7/2001 | Yanus et al. | 430/56 |
| 7,166,399 | B2 | 1/2007 | Carmichael et al. | |
| 7,455,941 | B2 | 11/2008 | Evans et al. | |
| 7,462,434 | B2 | 12/2008 | Yu et al. | |
| 8,168,356 | B2 | 5/2012 | Yu et al. | |
| 8,173,341 | B2 | 5/2012 | Yu et al. | |
| 8,343,700 | B2 * | 1/2013 | Yu et al. | 430/66 |
| 8,394,560 | B2 * | 3/2013 | Yu et al. | 430/64 |
| 8,404,413 | B2 * | 3/2013 | Yu et al. | 430/56 |
| 2008/0166643 | A1 * | 7/2008 | Bender et al. | 430/66 |
| 2008/0166644 | A1 * | 7/2008 | Bender et al. | 430/66 |
| 2010/0248102 | A1 * | 9/2010 | Wu | 430/56 |
| 2010/0297544 | A1 | 11/2010 | Yu et al. | |
| 2011/0053067 | A1 * | 3/2011 | Wu | 430/58.8 |
| 2011/0287352 | A1 * | 11/2011 | Yu et al. | 430/58.8 |

* cited by examiner

*Primary Examiner* — Christopher Rodee
(74) *Attorney, Agent, or Firm* — Pillsbury Winthrop Shaw Pittman LLP

(57) ABSTRACT

The disclosure provides a flexible electrophotographic imaging member having an optically clear, cross-linked anticurl back coating of melamine formaldehyde to effect complete and absolute imaging member flatness.

20 Claims, 2 Drawing Sheets

IMAGING MEMBERS HAVING A CROSS-LINKED ANTICURL BACK COATING

CROSS-REFERENCE TO RELATED APPLICATIONS

Reference is made to commonly owned and co-pending, U.S. patent application Ser. No. 13/940,145 entitled "Flexible Imaging Members Having Externally Plasticized Imaging Layers" to Robert C. U. Yu et al., electronically filed on the same day; and U.S. patent application Ser. No. 13/640,085 entitled "Imaging Members Having An Cross-Linked Anti-Curl Back Coating" to Robert C. U. Yu et al., electronically filed on the same day herewith, the entire disclosure of which is incorporated herein by reference in its entirety.

BACKGROUND

The presently disclosed embodiments relate generally to a flexible electrophotographic imaging member having an anti-curl back coating. The anticurl back coating of the flexible electrophotographic imaging member of the present disclosure not only provides wear/scratch resistance, it also gives the resulting imaging member flatness to meet the functional requirement of electrophotographic imaging apparatuses. While the present anticurl back coating (ACBC) can be used in all conventional electrophotographic imaging member designs, particular attention is focused on its application in a flexible multi-layered electrophotographic imaging member comprising a plasticized imaging layer.

In conventional prior art electrophotographic flexible imaging members, there may be included a photoconductive layer including a single layer or composite layers. One type of composite photoconductive layer used in xerography is illustrated in U.S. Pat. No. 4,265,990 which describes an imaging member having at least two electrically operative layers. One layer comprises a photoconductive layer or charge generating layer which is capable of photogenerating holes and injecting the photogenerated holes into a contiguous charge transport layer. Generally, where the two electrically operative layers are supported on a conductive layer, the charge generating layer is sandwiched between a contiguous charge transport layer and the supporting conductive layer. Alternatively, the charge transport layer may be sandwiched between the supporting electrode and a charge generating layer.

In the case where the charge generating layer is sandwiched between the outermost exposed charge transport layer and the electrically conducting layer, the outer surface of the charge transport layer is charged negatively and the conductive layer is charged positively. The charge generating layer then should be capable of generating electron hole pair when exposed image wise and inject only the holes through the charge transport layer. In the alternate case when the charge transport layer is sandwiched between the charge generating layer and the conductive layer, the outer surface of the charge generating layer is charged positively while conductive layer is charged negatively and the holes are injected through from the charge generating layer to the charge transport layer. The charge transport layer should be able to transport the holes with as little trapping of charge as possible. In flexible imaging member belt such as photoreceptor, the charge conductive layer may be a thin coating of metal on a flexible substrate support layer.

Typical negatively charged imaging member belts, such as flexible photoreceptor belt designs, are made of multiple layers comprising a flexible supporting substrate, a conductive ground plane, a charge blocking layer, an optional adhesive layer, a charge generating layer, a charge transport layer. The charge transport layer is usually the last layer, or the outermost layer, to be coated and is applied by solution coating then followed by drying the wet applied coating at elevated temperatures of about 120° C., and finally cooling it down to ambient room temperature of about 25° C. When a production web stock of several thousand feet of coated multilayered imaging member material is obtained after finishing solution application of the charge transport layer coating and through drying/cooling process, upward curling of the multilayered photoreceptor is observed. This upward curling is a consequence of thermal contraction mismatch between the charge transport layer and the substrate support. Since the charge transport layer in a typical imaging member has a coefficient of thermal contraction approximately 3.7 times greater than that of the flexible substrate support, the charge transport layer does therefore have a larger dimensional shrinkage than that of the substrate support as the imaging member web stock cools down to ambient room temperature. Since the typical flexible electrophotographic imaging member, if unrestrained, exhibits undesirable upward imaging member curling, an anticurl back coating, applied to the backside, is required to balance the curl. Thus, the application of anticurl back coating is necessary to provide the appropriate imaging member belt with desirable flatness.

Flexible electrophotographic imaging members having these electrically operative layers, as disclosed above, provide excellent electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a receiving member such as paper. However, when a negatively charged imaging member (e.g., in belt configuration) is in dynamic cyclic motion under a normal machine operation condition in the field, the anticurl back coating of conventional imaging members (as the outermost exposed backing layer) is subject to high surface contact friction when it slides and flexes over the machine subsystems of the belt support module, such as rollers, stationary belt guiding components, and backer bars. The mechanical/frictional sliding interactions of ACBC against the belt support module components have been found to create numbers of issues; such as: (1) exacerbate ACBC wear/abrasion, causing loss of anti-curling control capability and resulting in imaging member belt curling-up problem because the thinning of the ACBC reduces its curl control effectiveness to result in premature curling up of the imaging member that impacts normal imaging belt machine functioning condition, such as non-uniform charging for proper latent image formation; (2) create debris/dirt of ACBC wear-off that scatters and deposits on critical machine components such as lenses; (3) wear/abrasion/scratch damage in the ACBC does also produce unbalanced forces between the charge transport layer and the ACBC to cause micro belt ripples formation during electrophotographic imaging processe; (4) cause the development of tribo-electrical charge built-up in the ACBC that increases belt drive torque and, in some instances, it has been found to result in belt stalling; (5) in other cases, the tribo-electrical charge build up can be so high as to cause sparking; and lastly (6) under extensively cycled condition in precision electrostatographic imaging machines, an audible squeaky sound generation due to high contact friction interaction between the ACBC and the backer bars has also been a problem. Therefore, pre-mature ACBC failure shortens the imaging member belt functional life and requires frequent costly belt replacement in the field. Moreover, inclusion of an ACBC to provide flatness also incurs additional material and labor cost.

To overcome the abovementioned shortcomings association with the conventional ACBC in the flexible imaging member belt, research activities devoted to ACBC elimination have been pursued and ACBC-free flexible imaging members have been designed. To achieve the purpose of ACBC elimination, these imaging members are re-designed so that they contain a plasticized charge transport layer (CTL) which minimizes the CTL/substrate dimensional contraction mismatch for effecting internal tension stress/strain build-up reduction in the CTL. Even though the ACBC-free imaging members provide valid curl reduction, they do not render the desirable member flatness and still exhibit about 16 inch to about 25 inch diameter of curl-up curvature. As used herein, the measurement of curvature is determined by the following: a 2 inch×10 inch sample was cut from an ACBC-free imaging member and left unrestrained and free standing on a table. The extent of sample upward curling was then measured and recorded as its diameter of curl-up curvature.

While the fabricated ACBC-free flexible imaging members having a plasticized CTL produce good photo-electrical functioning stability results, quality copy prints, and curl suppression, they are unable to provide the resulting imaging members with complete flat configuration to meet the high volume machines imaging member belt flatness requirement. Moreover, the unprotected bottom side of the substrate of these imaging members is highly susceptible to the development of pre-mature onset of wear/scratch failure against the machine belt module support rollers and backer bars sliding mechanical friction action under a normal dynamic belt cycling machine operation condition. This causes generation of large amount of debris and/or dust particles inside the machine cavity to adversely impede proper imaging member belt functional operation.

Thus, there exists a need to provide a flexible electrophotographic imaging member with an ACBC re-formulation that improves physical/mechanical function and does not suffer from the abovementioned issues while providing the imaging member flatness to meet machine functioning requirement.

SUMMARY

According to embodiments illustrated herein, there is provided flexible electrophotographic imaging member comprising a substrate; a charge generating layer disposed on the substrate; a charge transport layer disposed on the charge generating layer; and an anticurl back coating layer having a three-dimensional cross-linked network of bonds disposed on the substrate on a side opposite to the charge transport layer, wherein the anticurl back coating layer comprises crosslinked melamine formaldehyde.

In particular, the present embodiments provide a flexible electrophotographic imaging member comprising a substrate; a charge generating layer disposed on the substrate; a charge transport layer disposed on the charge generating layer, the charge transport layer comprising a plasticizer; and an anticurl back coating layer having a three-dimensional cross-linked network of bonds disposed on the substrate on a side opposite to the charge transport layer, wherein the anticurl back coating layer is formed from a coating solution comprising a polyhydroxyalkyl arcrylate binder, a methylolated melamine having the formula

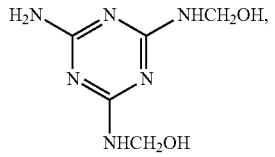

a catalyst, and a solvent, and further wherein the cross-linked network of bonds is formed from the reaction between the methylolated melamine and the polyhydroxyalkyl arcrylate binder to obtain a cross-linked polyacrylate/melamine-formaldehyde anticurl back coating layer In further embodiments, there is provided an image forming apparatus for forming images on a recording medium comprising a) an electrophotographic imaging member having a charge retentive-surface for receiving an electrostatic latent image thereon, wherein the imaging member comprises a substrate; a charge generating layer disposed on the substrate; a charge transport layer disposed on the charge generating layer; and an anticurl back coating layer having a three-dimensional cross-linked network of bonds disposed on the substrate on a side opposite to the charge transport layer, wherein the anticurl back coating layer comprises crosslinked melamine formaldehyde; b) a development component adjacent to the charge-retentive surface for applying a developer material to the charge-retentive surface to develop the electrostatic latent image to form a developed image on the charge-retentive surface; c) a transfer component adjacent to the charge-retentive surface for transferring the developed image from the charge-retentive surface to a copy substrate; and d) a fusing component adjacent to the copy substrate for fusing the developed image to the copy substrate.

BRIEF DESCRIPTION OF THE DRAWINGS

For a better understanding of the present disclosure, reference may be made to the accompanying figures.

DETAILED DESCRIPTION

Figure 1:
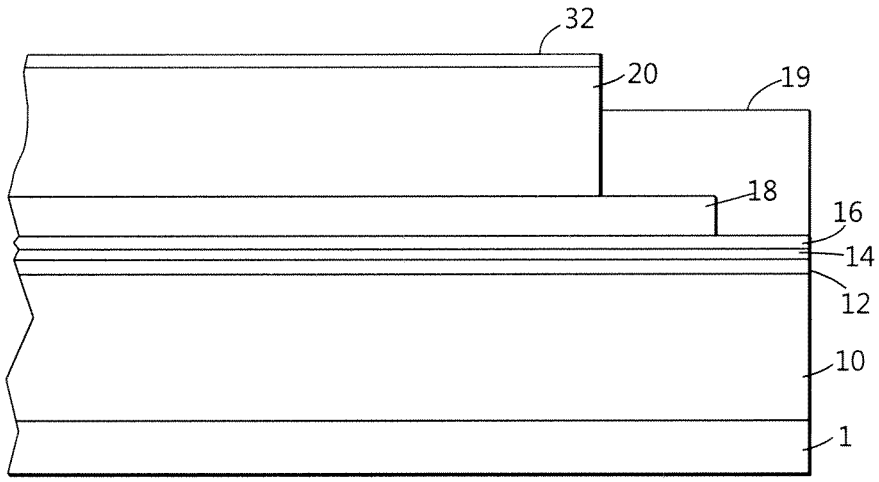
FIG. 1 is a schematic cross-sectional view of a conventional negatively charged flexible imaging member belt having a standard ACB

In the following description, reference is made to the accompanying drawings, which form a part hereof and which illustrate the exemplary embodiments of the present disclosure herein and not for the purpose of limiting the same. It is also understood that other embodiments may be utilized and structural and operational changes may be made without departure from the scope of the present disclosure.

Conventional negatively charged flexible electrophotographic imaging member belts, comprising a single or composite photoconductive layers, such as for example, the charge generation layer (CGL) and CTL, through subsequent coating application of CGL over a flexible substrate support and CTL onto the CGL, exhibit undesirable upward imaging member curling. To offset and control the curl, an ACBC is required to be coated onto the back side (opposite to the photoconductive layer(s) side) of the substrate support to impart the imaging member with desirable flatness.

In the present innovative effort, the disclosure is focused on improving the negatively charged flexible electrophotographic imaging member belt design to effect service life extension in the field. This is by means of providing methodology to render the resulting imaging member belt with superior wear/scratch resistant ACBC formulation of this disclosure and photo-electrical stability enhancement as well to impact service life extension and meet the quality/cost reduction delivery objective. To achieve this very purpose, the flexible negatively charged multiple layered electrophotographic imaging member belt of conventional prior art is to be modified and prepared to have two material redesigned formulations: with one comprising an ACBC replacement of this disclosure, while the other contains a plasticized CTL/CGL and a thin disclosed ACBC for effecting curl control to render absolute imaging member belt flatness. The flexible negatively charged multiple layered electrophotographic imaging member belts described in all the preceding may alternatively include an optional top outermost protective overcoat layer over the CTL.

The specific terms are used in the following description for clarity, selected for illustration in the drawings and not to define or limit the scope of the disclosure. The structures in the figures are not drawn according to their relative proportions and the drawings should not be interpreted as limiting the disclosure in size, relative size, or location. In addition, though the discussion will address negatively charged systems, the imaging member belts of the present disclosure may also included material compositions designed to be used in positively charged systems. Also the term "photoreceptor" or "photoconductor" or photosensitive member is generally used interchangeably with the terms "imaging member." The term "electrostatographic" includes "electrophotographic" and "xerographic." The terms "charge transport molecule" are generally used interchangeably with the terms "hole transport molecule."

According to aspects illustrated herein, there is provided a negatively charged flexible imaging member belt comprising a flexible substrate support; a charge generating layer disposed on the substrate; a charge transport layer (CTL) disposed on the charge generating layer (CGL); and an anticurl back coating (ACBC) of present disclosure disposed on the substrate support on a side opposite to the CGL/CTL. The disclosed ACBC in the embodiments is prepared to comprise a cross-linked melamine formaldehyde layer.

FIG. 1 illustrates an exemplary embodiment of a negatively charged multi-layered flexible electrophotographic imaging member web of conventional prior art design. Specifically, it shows the structure of a conventional flexible multiple layered electrophotographic imaging member web comprising a substrate 10, an optional a conductive layer 12, an optional hole blocking layer 14 over the optional conductive layer 12, and an optional adhesive layer 16 over the blocking layer 14, a charge generating layer (CGL) 18, a charge transport layer (CTL) 20, an optional ground strip layer 19 operatively connects the CGL 18 and the CTL 20 to the optional conductive layer 12, an optional over coat layer 32, and an ACBC 1 to render appropriate imaging member flatness. A ground strip layer 19 may be included to effect electrical continuity. The optional overcoat layer 32 may be included to provide abrasion/wear protection for the CTL 20. Typically, the ACBC layer 1, being the outermost bottom layer, is to be applied onto the backside of substrate 10, opposite to the electrically active layers, for impacting imaging member curl control and provide substrate 10 protections against scratch/wear failure. An exemplary imaging member having a belt configuration is disclosed in U.S. Pat. No. 5,069,993, which is hereby incorporated by reference. U.S. Pat. Nos. 7,462,434; 7,455,941; 7,166,399; and 5,382,486 further disclose exemplary imaging members, which are hereby incorporated by reference.

Referring back to FIG. 1, embodiments of present disclosure are directed generally to an improved flexible imaging member, particularly for improving this very same flexible multiple layered electrophotographic imaging member, in which the CTL 20 is then included with a plasticizer to effect internal stress/strain reduction and the ACBC 1 is reformulated by the use of a high molecular weight film forming A-B diblock copolymer and likewise incorporated a plasticizer according to the description of this disclosure for effective curl control and improve mechanical function as well. The resulting imaging member thus obtained is curl-free and flat.

Although the formation and coating of the CGL 18 and the plasticized CTL 20 of the negatively charged imaging member described and shown in all the four the figures here has two separate layers, nonetheless it will also be appreciated that the functional components of these two layers may however be combined and formulated into a single plasticized layer to give a structurally simplified imaging member. Alternatively, the CGL 18 may also be disposed on top of the plasticized CTL 20, so the imaging member as prepared is therefore converted into a positively charge imaging member.

The Substrate

The imaging member support substrate 10 is a flexible layer and may be opaque but preferably to be substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate (PET) from DuPont, or polyethylene naphthalate (PEN) available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of different configurations, such as for example, a plate, a cylinder, a drum, a scroll, an endless flexible belt, and the like. In the case of the substrate being in the form of a belt, as shown in the figures, the belt can be seamed or seamless. In certain embodiments, the photoreceptor is rigid. In certain embodiments, the photoreceptor is in a drum configuration.

The thickness of the substrate 10 of a flexible belt depends on numerous factors, including flexibility, mechanical performance, and economic considerations. The thickness of the flexible support substrate 10 of the present embodiments may be from 1.0 to about 7.0 mils; or from about 2.0 to about 5.0 mils.

The substrate support 10 is not soluble in the solvents used in each of the coating layer solutions. The substrate support 10 is optically transparent or semitransparent. The substrate support 10 remains physical/mechanical stable at temperature below about 170° C. Therefore, at or below 170° C. the substrate support 10, below which temperature, may have a thermal contraction coefficient ranging from about $1\times10^{-5}$/° C. to about $3\times10^{-5}$/° C. and a Young's Modulus of between about $5\times10^5$ psi ($3.5\times10^4$ Kg/cm$^2$) and about $7\times10^5$ psi ($4.9\times10^4$ Kg/cm$^2$).

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer is from about 20 Angstroms to about 750 Angstroms, or from about 50 Angstroms to about 200 Angstroms, for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as transparent layer for light having a wavelength between about 4000 Angstroms and about 9000 Angstroms or a conductive carbon black dispersed in a polymeric binder as an opaque conductive layer.

The Hole Blocking Layer

After deposition of the electrically conductive ground plane layer 12, the hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutyral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,338,387, 4,286,033 and 4,291,110.

The hole blocking layer should be continuous and have a thickness of less than about 0.5 micrometer because greater thicknesses may lead to undesirably high residual voltage. A hole blocking layer of between about 0.005 micrometer and about 0.3 micrometer is used because charge neutralization after the exposure step is facilitated and optimum electrical performance is achieved. A thickness of between about 0.03 micrometer and about 0.06 micrometer is used for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Adhesive Layer

An optional separate adhesive interface layer 16 may be provided in certain configurations, such as, for example, in flexible web configurations. In the embodiment illustrated in the figure, the interface layer 16 would be situated between the blocking layer 14 and the CGL 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik Inc., 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying CGL 18 to enhance adhesion bonding to provide linkage. In yet other embodiments, the adhesive interface layer is entirely omitted.

Any suitable solvent or solvent mixtures may be employed to form a coating solution of the polyester for the adhesive interface layer. Solvents may include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Application techniques may include spraying, dip coating, roll coating, wire wound rod coating, and the like. Drying of the deposited wet coating may be effected by any suitable conventional process, such as oven drying, infra red radiation drying, air drying, and the like.

The adhesive interface layer 16 may have a thickness of at least about 0.01 micrometer, and no more than about 900 micrometers after drying. In certain embodiments, the dried thickness is from about 0.03 micrometer to about 1.00 micrometer, or from about 0.05 micrometer to about 0.50 micrometer.

The Ground Strip Layer

The ground strip layer 19 may comprise a film-forming polymer binder and electrically conductive particles. Typical film forming binder may include, for example, A-B diblock copolymer, polycarbonate, polystyrene, polyacrylate, polyarylate, and the like. Any suitable electrically conductive particles may be used in the electrically conductive ground strip layer 19. The ground strip 19 may comprise materials which include those enumerated in U.S. Pat. No. 4,664,995. Electrically conductive particles include carbon black, graphite, copper, silver, gold, nickel, tantalum, chromium, zirconium, vanadium, niobium, indium tin oxide and the like. The electrically conductive particles may have any suitable shape. Shapes may include irregular, granular, spherical, elliptical, cubic, flake, filament, and the like. The electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer 19 may have a thickness of from about 7 micrometers to about 42 micrometers, from about 14 micrometers to about 27 micrometers, or from about 17 micrometers to about 22 micrometers.

The Charge Generation Layer

The CGL 18 may thereafter be applied to the undercoat layer 14. Any suitable charge generation binder including a charge generating/photoconductive material, which may be in the form of particles and dispersed in a film-forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film-forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

A number of titanyl phthalocyanines, or oxytitanium phthalocyanines for the photoconductors illustrated herein are photogenerating pigments known to absorb near infrared light around 800 nanometers, and may exhibit improved sensitivity compared to other pigments, such as, for example, hydroxygallium phthalocyanine. Generally, titanyl phthalocyanine is known to have five main crystal forms known as Types I, II, III, X, and IV. For example, U.S. Pat. Nos. 5,189,155 and 5,189,156, the disclosures of which are totally incorporated herein by reference, disclose a number of methods for obtaining various polymorphs of titanyl phthalocyanine. Additionally, U.S. Pat. Nos. 5,189,155 and 5,189,156 are directed to processes for obtaining Types I, X, and IV phthalocyanines. U.S. Pat. No. 5,153,094, the disclosure of which is totally incorporated herein by reference, relates to the preparation of titanyl phthalocyanine polymorphs including Types I, II, III, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

Any suitable inactive resin materials may be employed as a binder in the CGL 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly(4,4'-dihydroxydiphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, the charge generating material is dispersed in an amount of from about 5 percent to about 95 percent by volume, from about 20 percent to about 80 percent by volume, or from about 40 percent to about 60 percent by volume of the resinous binder composition.

The CGL 18 containing the charge generating material and the resinous binder material generally ranges in thickness of from about 0.1 micrometer to about 5 micrometers, or from about 0.2 micrometer to about 3 micrometers. In certain embodiments, the charge generating materials in CGL 18 may include chlorogallium phthalocyanine, hydroxygallium phthalocyanines, or mixture thereof.

The CGL thickness is generally related to binder content. Higher binder content compositions generally employ thicker layers for charge generation layers.

The Conventional Charge Transport Layer

Although the CTL is discussed specifically in terms of a single layer 20, the details apply to embodiments having dual or multiple charge transport layers. The CTL 20 of conventional design is typically applied by solution coating over the CGL 18. In the coating process, the CTL along the adjacent ground strip layer is disposed on the CGL by co-coating application. The conventional CTL 20 may include a film forming transparent organic polymer or a non-polymeric material. Such transparent organic polymers and non-polymeric materials are capable of supporting the injection of photogenerated holes or electrons from the CGL 18 to allow the transport of these holes/electrons through the conventional CTL 20 to selectively discharge the surface charge on the imaging member surface. During the electrophotographic imaging process, the conventional CTL 20 supports holes transporting, and protects the CGL 18 from abrasion or chemical attack, thereby extends the service life of the imaging member. Interestingly, the conventional CTL 20 may be a substantially non-photoconductive material, yet it supports the injection of photogenerated holes from the CGL 18 below.

The conventional CTL 20 is normally transparent in a wavelength region in which the electrophotographic imaging member is to be used when exposure is affected there to ensure that most of the incident radiation is utilized by the underlying charge generation layer 18. The conventional CTL 20 should exhibit excellent optical transparency with negligible light absorption and no charge generation when exposed to a wavelength of light useful in xerography, e.g., 400 to 900 nanometers. In the case when the imaging member is prepared with the use of a transparent support substrate 10 and also a transparent conductive ground plane 12, image wise exposure or erase may alternatively (or optionally) be accomplished through the substrate 10 with all light passing through the back side of the support substrate 10. In this particular case, the materials of the conventional CTL 20 need not have to be able to transmit light in the wavelength region of use for electrophotographic imaging processes if the charge generating layer 18 is sandwiched between the support substrate 10 and the conventional CTL 20. In all events, the top conventional CTL 20 in conjunction with the charge generating layer 18 is an insulator to the extent that an electrostatic charge deposited/placed over the conventional CTL 20 is not conducted in the absence of radiant illumination. Importantly, the conventional CTL 20 should trap minimal or no charges as the charge pass through it during the image copying/printing process.

Typically, the conventional CTL 20 disclosed in all prior arts is a binary solid solution comprising a film forming polymer and charge transport compound or activating compound useful as an additive dissolved or molecularly dispersed in an electrically inactive polymeric material, such as a polycarbonate binder, to form a solid solution and thereby making this material electrically active. "Dissolved" refers, for example, to forming a solid solution in which the small molecule is dissolved in the polymer to form a homogeneous phase; and molecularly dispersed in all descriptions refers, for example, to charge transporting molecules dispersed in the polymer, the small molecules being dispersed in the polymer on a molecular scale.

The charge transport component may be added to a plasticized film-forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the CGL 18 and capable of allowing the transport of these holes through the conventional CTL 20 in order to discharge the surface charge on the conventional CTL 20. The high mobility charge transport component may comprise small molecules of an organic compound which cooperate to transport charge between molecules and ultimately to the surface of the conventional CTL 20.

A number of charge transport compounds can be included in the conventional CTL 20. Examples of charge transport components are aryl amines of the following formulas:

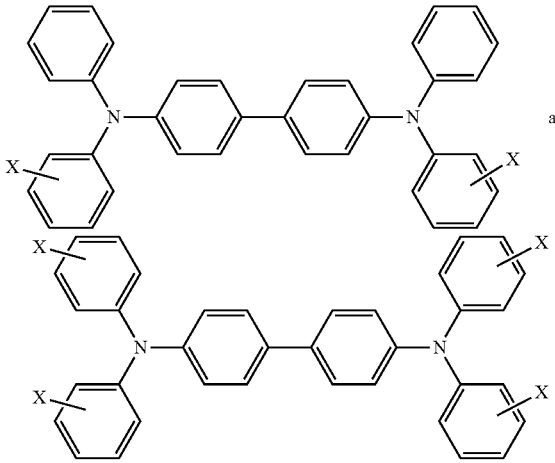

and wherein each X is independently alkyl, alkoxy, aryl, and derivatives thereof, or a halogen, or mixtures thereof. In certain embodiments, each X is independently Cl or methyl. Additional examples of charge transport components are aryl amines of the following formulas:

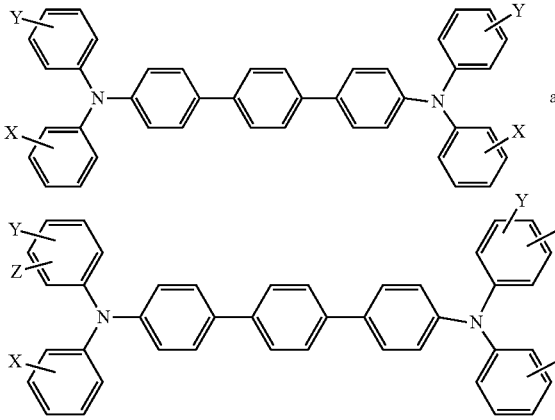

and wherein X, Y and Z are independently alkyl, alkoxy, aryl, halogen, or mixtures thereof, and wherein at least one of Y and Z are present.

Alkyl and alkoxy may be substituted or unsubstituted, containing from 1 to about 25 carbon atoms, and more specifically, from 1 to about 12 carbon atoms, such as methyl, ethyl, propyl, butyl, pentyl, and the corresponding alkoxides. Aryl may be substituted or unsubstituted, containing from 6 to about 36 carbon atoms, such as phenyl, and the like. Halogen includes chloride, bromide, iodide, and fluoride.

Exemplary charge transport components include aryl amines such as N,N'-diphenyl-N,N'-bis(methyllphenyl)-1,1-biphenyl-4,4'-diamine, N,N,N',N'-tetra-p-tolyl-1,1'-biphenyl-4,4'-diamine, N,N'-diphenyl-N,N'-bis(chlorophenyl)-1,1'-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine. In one embodiment, the charge transport component is N,N'-diphenyl-N,N'-bis(3-methyl phenyl)-1,1'-biphenyl-4,4'-diamine (TPD) and N,N,N',N'-tetra-p-tolyl-1,1'-biphenyl-4,4'-diamine (TM-TPD), and the like. Other known charge transport layer components may be selected in embodiments, reference for example, U.S. Pat. Nos. 4,921,773 and 4,464,450, the disclosures of which are totally incorporated herein by reference.

In one embodiment, the charge transport component is N,N'-diphenyl-N,N-bis(3-methyl phenyl)-1,1'-biphenyl-4,4'-diamine (TPD). In another embodiment, the charge transport component is N,N,N',N'-tetra-p-tolyl-1,1'-biphenyl-4,4'-diamine (TM-TPD).

Examples of the binder materials selected for the CTL 20 include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof. In one embodiment, the charge transport layer includes polycarbonates.

Typically, the formulation of the conventional CTL 20 is a solid solution which includes a charge transport compound molecularly dispersed or dissolved in a film forming polycarbonate binder, such as poly(4,4'-isopropylidene diphenyl carbonate) bisphenol A polycarbonate), or poly(4,4'-diphenyl-1,1'-cyclohexane carbonate) (i.e., bisphenol Z polycarbonate).

Bisphenol A polycarbonate used for the conventional CTL 20 formulation is available commercially: MAKROLON (from Farbensabricken. Bayer A.G) or FPC 0170 (from Mitsubishi Chemicals). Bisphenol A polycarbonate, poly(4,4'-isopropylidene diphenyl carbonate), has a weight average molecular weight of from about 80,000 to about 250,000, and a molecular structure of Formula X below:

Formula X

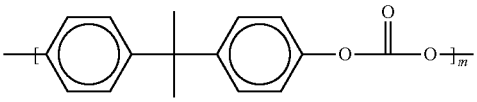

wherein m is the degree of polymerization, from about 310 to about 990. Bisphenol Z polycarbonate, poly(4,4'-diphenyl-1,1'-cyclohexane carbonate), has a weight average molecular weight of from about 80,000 to about 250,000, and a molecular structure of Formula Y below:

Formula Y

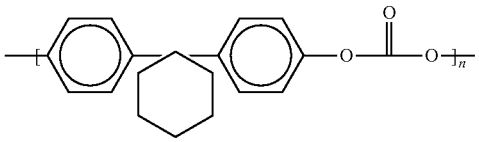

wherein n is the degree of polymerization, from about 270 to about 850.

The conventional CTL 20 is an insulator to the extent that the electrostatic charge placed on the conventional CTL 20 surface is not conducted in the absence of illumination at a rate sufficient to prevent formation and retention of an electrostatic latent image thereon. The conventional CTL 20 is substantially non-absorbing to visible light or radiation in the region of intended use. The conventional CTL 20 is yet electrically "active," as it allows the injection of photogenerated holes from the charge generation layer 18 to be transported through itself to selectively discharge a surface charge presence on the surface of the conventional CTL 20.

Any suitable and conventional technique may be utilized to form and thereafter apply the conventional CTL 20 coating solution to the supporting substrate layer. The conventional CTL 20 may be formed in a single coating step to give single conventional CTL 20 or in multiple coating steps to produce dual layered or multiple layered CTLs. Dip coating, ring coating, spray, gravure or any other coating methods may be used. For dual layered design, the CTL 20 includes a top CTL and a bottom CTL in contiguous contact with the CGL 18. The top CTL may contain less charge transport compound than the bottom CTL for impacting mechanically robust function. The top and bottom CTLs may have different thickness, or the same thickness. Drying of the applied wet coating layer(s) may be effected by any suitable conventional technique such as oven drying, infra red radiation drying, air drying and the like.

During the manufacturing process of a conventional negatively charged flexible imaging member, the conventional CTL 20 is coated over the CGL 18 by applying a CTL solution coating on top of the CGL 18, then subsequently drying the wet applied CTL coating at elevated temperatures of about 120° C., and finally cooling down the coated imaging member web to the ambient room temperature of about 25° C. Due to the thermal contraction mismatch between the conventional CTL 20 and the substrate support 10, the processed imaging member web (after finishing CTL drying/cooling process), if unrestrained, does exhibit spontaneous upward curling as a result of greater dimensional contraction of conventional CTL 20 than that of substrate support 10.

Without being bounded by theory, the development of this upward imaging member curling may be explained by the following mechanisms:

(1) while the imaging member web after application of wet CTL coating (typically comprising equal parts of a polycarbonate binder and a specific diamine charge transport compound dissolved in an organic solvent) over a 3½ mil polyethylene naphthalate substrate (or a polyethylene terephthalate) is dried at elevated temperature (120° C.), the solvent(s) of the CTL coating solution evaporates leaving a viscous free flowing CTL liquid where the CTL releases internal stress, and maintains its lateral dimension stability without causing the occurrence of dimensional contraction;

(2) during the cool down period, the temperature falls and reaches the glass transition temperature (Tg) of the CTL at 85° C., the CTL instantaneously solidifies and adheres to the underneath CGL as it transforms from being a viscous liquid into a solid layer; and (3) as the CTL temperature subsequently drops from its Tg of 85° C. down to the 25° C. room ambient, the solid CTL in the imaging member web laterally contracts more than the flexible substrate support due to significantly higher thermal coefficient of dimensional contraction than that of the substrate support. Such differential in dimensional contraction between these two layers results in internal tension strain built-up in the CTL and compression the substrate support layer, which therefore pulls the imaging member web upwardly to exhibit curling. That means the processed Imaging member web (with the finished CTL coating obtained through drying/cooling process) does spontaneously curl upwardly into a roll.

The internal tension pulling strain built-up in the dried CTL 20 (caused by differential dimensional contraction between CTL 20 and substrate 10 to result in spontaneous upward imaging member curling) can be calculated according to the expression of equation (1) below:

$$\epsilon=(\alpha_{CTL}-\alpha_{sub})(Tg_{CTL}-25^\circ\text{ C.}) \quad (1)$$

wherein $\epsilon$ is the internal strain build-in in the charge transport layer, $\alpha_{CTL}$ and $\alpha_{sub}$ are coefficient of thermal contraction of conventional CTL 20 and substrate 10 respectively, and $Tg_{CTL}$ is the glass transition temperature of the conventional CTL 20.

The thickness of the conventional CTL 20 (being a single, dual, or multiple layered CTLs), after drying and cooling steps, is about 29 micrometers for optimum photoelectrical and mechanical results. Note: the conventional CTL 20 does typically have a Young's Modulus of about $3.5\times10^5$ psi and a thermal contraction coefficient of about $6.6\times10^{-5}$/° C. compared to the Young's Modulus of about $5.4\times10^5$ psi and the thermal contraction coefficient of about $1.8\times10^{-5}$/° C. for the conventional polyethylene terephthalate substrate support.

In essence, if the completed imaging member web having a 29-micrometer thickness of dried conventional CTL 20 (comprising equal parts of a polycarbonate binder and a specific diamine charge transport compound), is coated over a 3½ mil polyethylene terephthalate (or a polyethylene naphthalate) substrate support 10 and being unrestrained, it will spontaneously curl-up into a 1½-inch roll. So to balance the curl and render desirable imaging member web flatness, a standard ACBC 1 having a conventional composition is generally included in prior imaging member web.

The Conventional Anti-Curl Back Coating Layer

As the imaging member web exhibits spontaneous upward curling after the completion of the conventional CTL 20 coating/drying and cooling processes, a conventional ACBC 1 is applied to the back side of the substrate 10 to counteract the curl and render flatness. Typically, a conventional ACBC for effective curl control is formulated to comprised of a film forming polymer and a small amount of an adhesion promoter. Although the film forming polymer employed in the conventional ACBC 1 formulation may be different from the polymer binder used in the conventional CTL 20, but it is preferred to be the exact same one as that in the conventional CTL. It is also important to mention that that the polymer(s) used in the conventional ACBC formulation and that in the conventional CTL has about equivalent thermal contraction coefficient to effect best imaging member curl control outcome. For imaging member having a typical 29 micrometers CTL 20 thickness, a conventional 17 micrometers polycarbonate ACBC 1 is need to balance/control the curl and render flatness.

The applied conventional ACBC 1 is, however, required to have suitable optically transmittance (e.g., transparency), so that the residual voltage remaining after completion of a photoelectrical imaging process on the imaging member surface can conveniently be erased by radiation illumination directed from the back side of the imaging member through the ACBC thickness of the imaging member during electrophotographic imaging processes. In addition, since the imaging member in flexible belt configuration is mounted over to encircle around a machine belt module and be supported by a number of belt module rollers and backer bars, so it is necessary that the ACBC 1 (under a dynamic imaging member belt cyclic machine functioning condition in the field) should also have adequate mechanical robustness of good wear resistance to withstand the frictional action against these belt module support components.

The Optional Overcoat Layer

Referring to FIG. 1, the imaging member may also include, for example, an optional over coat layer 32. An optional overcoat layer 32, if desired, may be disposed over the charge transport layer 20 to provide imaging member surface protection as well as improve resistance to abrasion. Therefore, typical overcoat layer is formed from a hard and wear resistance polymeric material. In embodiments, the overcoat layer 32 may have a thickness ranging from about 0.1 micrometer to about 10 micrometers or from about 1 micrometer to about 5 micrometers, or in a specific embodiment, about 3 micrometers. These over-coating layers may include thermoplastic organic polymers or inorganic polymers that are electrically insulating or slightly semi-conductive. For example, overcoat layers may be fabricated from a dispersion including a particulate additive in a resin. Suitable particulate additives for overcoat layers include metal oxides including nano particles of aluminum oxide, non-metal oxides including silica or low surface energy polytetrafluoroethylene (PTFE), and combinations thereof. Suitable resins for use include those described in the preceding for photogenerating layers and/or charge transport layers, for example, the A-B diblock copolymer, polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly-N-vinylpyrrolidinones, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and combinations thereof. Overcoating layers may be continuous and have a thickness of at least about 0.5 micrometer, or no more than 10 micrometers, and in further embodiments have a thickness of at least about 2 micrometers, or no more than 6 micrometers.

The Disclosure Imaging Member I

Figure 2:
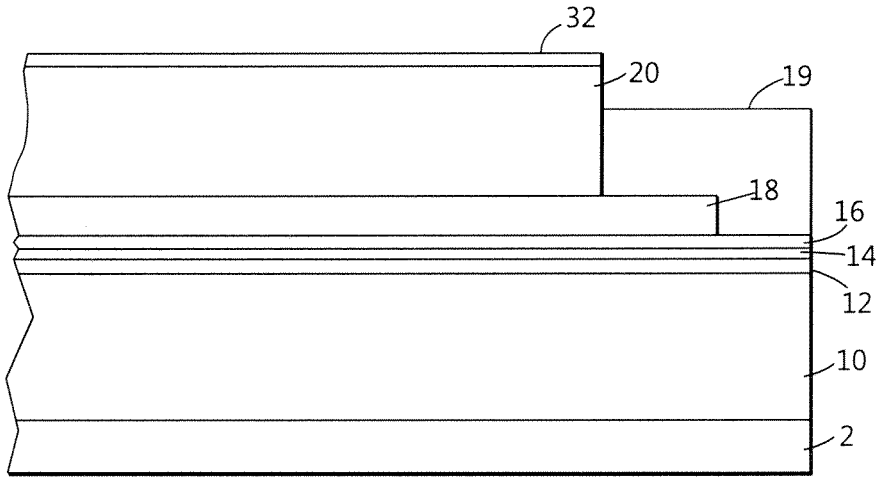
FIG. 2 is a schematic cross-sectional view of a first exemplary embodiment of a flexible imaging member belt modified from the conventional imaging member belt by utilizing a replacement ACBC prepared according to the description of present disclosure.

The flexible imaging member web, shown in FIG. 2, is a modification of prior art imaging member web described in FIG. 1. The modified imaging member is prepared to have identical layers, material compositions, and followed the same procedures detailed above, but with the exception that the 17-micrometer thick standard polycarbonate ACBC 1 is replaced with a physically and mechanically robust 19-micrometer thick cross-linked melamine formaldehyde ACBC 2 of this disclosure for curl control and balance the top exposed 29-micrometer CTL 20.

Since the conventional prior art imaging members do employed a typical CTL 20 thickness in the range of from about 10 to about 35 micrometers, the disclosed cross-linked melamine formaldehyde ACBC 2 is required to have a thickness of between about 8 and about 32 micrometers to effect absolute imaging member flatness control.

In a first exemplary embodiment of the present disclosure, the design of the disclosed melamine-formaldehyde ACBC is formulated, to have a binary material compositions, by first reacting the melamine with formaldehyde to give methylolated melamines which are then subsequently cross-linked, among themselves, into a three-dimensional cross-linked network by condensation reaction activated at an elevated temperature or an elevated temperature and a catalyst. The term "methylolated melamine" means that the melamine is already reacted or combined with the formaldehyde. In embodiments, the elevated temperature is in a range of from about 120 to about 130° C. The mole ratio of melamine to formaldehyde is from about 1:2 to about 1:6. The chemical reactions leading to the formation of a cross-linked melamine-formaldehyde ACBC layer of the present disclosure are described and represented by the following two reaction steps:

(I) the methylolation reaction of melamine and formaldehyde

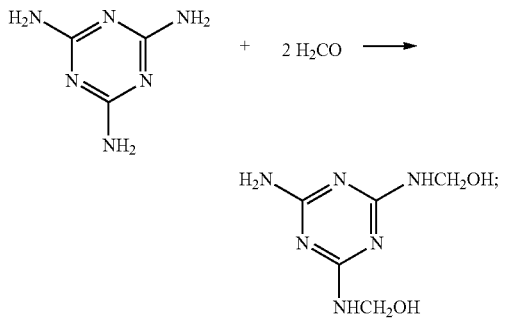

and (II) the condensation/cross-linking reaction of methylolated melamine to form three dimensional network

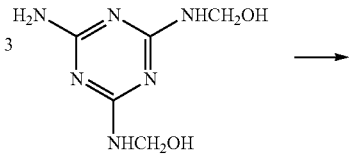

-continued

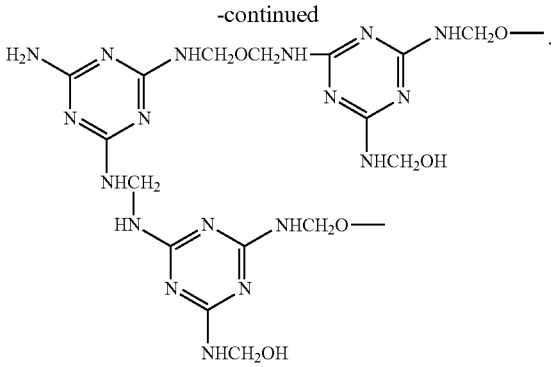

The condensation reaction between two —OH terminal of different molecules may spontaneously occur at an elevated temperature to give a crosslinked network. In embodiments, the elevated temperature is in a range of from about 120 to about 130° C. Otherwise, the condensation reaction may alternatively be carried out in the present of a catalyst. Typical catalysts suitable for use to activate the cross-linking reaction or condensation reaction include dibutyltin dilaurate, zinc octoate, para-toluene sulfonic acid, and mixtures thereof. The mole ratio of melamine to formaldehyde may be from about 1:1 to about 1:3.

In a second exemplary embodiment, the melamine-formaldehyde ACBC layer may alternatively be reformulated to give a design variance of having triple material composition include melamine, formaldehyde, and a binder. The binder suitable for use in the creation of a triple composition cross-linked polyacrylate/melamine-formaldehyde ACBC of this disclosure is a polyhydroxyalkyl arcrylate or hydroxyl functional acrylic polyol which may be selected from the groups consisting of polyhydroxymethyl acrylate, polyhydroxyethyl acrylate, polyhydroxyproyl acrylate, polyhydroxybutyl acrylate, polyhydroxypentyl acrylate, polyhydroxyhexyl acrylate, and mixtures thereof. The mole ratio of melamine to formaldehyde is from about 1:1 to about 1:3. The polyhydroxyalkyl arcrylate may be present in an amount of from about 20 to about 50 weight percent, or from about 30 to about 40 weight percent, based on the total weight of the prepared dried cross-linked polyacrylate/melamine-formaldehyde ACBC.

The weight average molecular weight of polyhydroxyalkyl arcrylate is in a range of from about 5,000 to about 50,000, or from about 10,000 to about 30,000.

One specific example of a hydroxyl functional acrylic polyol binder is Joncryl 587 (a polyhydroxymethyl acrylate commercially available from BASF) having a weight average molecular weight of about 14,000 and contains hydroxyl groups at the polymer side chains readily for effective cross-linking reaction in the presence of methylolated melamine-formaldehyde to form a 3-dimensional network.

In essence, the melamine-formaldehyde ACBC can be prepared by adding a hydroxyl functional acrylic polyol to a methylolated melamine resin, such as, Cymel 303LF, commercially available from Cytec, with an optional catalyst, in a solvent to form a coating solution. The coating solution can be applied over substrate support opposite to the site of the CTL/CGL layers. The applied wet coating is then dried under an elevated temperature to evaporate away the solvent while the methylolated melamine-formaldehyde acts as a cross-linker to link with the hydroxyl side groups of the acrylic polyol molecules into a 3-dimensional cross-linked network ACBC of this disclosure.

The resulting melamine-formaldehyde ACBC layer of the present disclosure, thus obtained either as a binary material composition or a triple material composition described in the above embodiments, is an optically clear and substantially continuous cross-linked coating layer. The melamine-formaldehyde ACBC layer may be a uniform melamine-formaldehyde cross-linked coating layer.

Preparation of ACBC Free Imaging Member Containing Plasticized Charge Transport Layer, Charge Generation Layer, and Ground Strip Layer From imaging member manufacturing point of view, the addition of an ACBC in the conventional prior art flexible imaging member incurs material cost, adds labor involvement, and also reduces daily imaging member product throughput too, so efforts devoted to the elimination of ACBC 1 from the imaging member of FIG. 1 has been pursued. In the most recent negatively charged flexible electrophotographic imaging member development break through, structurally simplified imaging member designs (with the elimination of ACBC 1 from FIG. 1) have been successfully achieved and demonstrated by CTL plasticizing approach. In these structurally simplified imaging member belts, incorporation of a high boiler liquid plasticizer (say diethyl phthalate) into the CTL of the negatively charge imaging member web helps to effect reduction of dimensional contraction differential between the CTL and the flexible substrate support caused by heating/drying and cooling steps during imaging member preparation process to thereby relieving the internal tension stress/strain build-up in the CTL and minimizes the degree of the imaging member curl-up. In likewise manner, the ground strip layer is also incorporated with a plasticizer same as that used in the CTL to complement the imaging member curl control effect.

To minimize the dimensional thermal contraction mismatched magnitude between the CTL 20 and the support substrate 10 of the conventional imaging member in FIG. 1, liquid plasticizer is then incorporated into the CTL 20 to effect $Tg_{CTL}$ lowering for internal strain C reduction and give successful imaging member curl suppression result in accordance to equation (1). The selection of viable plasticizer(s) for CTL incorporation has to meet the requirements of: (a) high boiler liquids with boiling point exceeding 250° C. to insure its permanent presence, (b) completely miscible/compatible with both the polymer binder and the charge transport component such that its incorporation into the CTL material matrix cause no deleterious photoelectrical function of the resulting imaging member, and (c) be able to maintain the optical clarity of the prepared plasticized CTL for effecting electrophotographic imaging process. In the same manner, the CGL 18 and the ground strip layer 19 adjacent to CTL 20 are likewise plasticized to provide complementary imaging member curl control for effecting ACBC elimination to give structurally simplified imaging member shown in FIG. 3. The CTL 20P, CGL 19P, and ground strip 19P may be plasticized with a dialkyl phthalate liquid, a dially phthalate liquid, 3-(trifluoromethyl)phenylacetone, or mixtures thereof. The amount of plasticizer presence in each of the CTL 20P, CGL 19P, and ground strip 19P of this ACBC-free imaging member is in the range of from about 5 percent weight to about 14 percent weight, from about 6 percent weight to about 12 percent weight, or from about 7 percent weight to about 9 percent weight, based on the total weight of each respective plasticized layer. The thickness of the plasticized CTL 20P is typically in the range of from about 10 to about 35 micrometers, from about 20 to about 30 micrometers, or about 29 micrometers.

In a specific embodiment, an 8% wt diethyl phthalate plasticizer incorporation is used in these layers to provide internal stress/strain reduction and render curl suppression, so the resulting ACBC-free imaging member as prepared has a substantially curl-free or nearly flat configuration. The thickness of the 8% wt diethyl phthalate plasticized CTL 20P (being a single, dual, or multiple layered CTLs with every layer plasticized) after drying is typically about 29 micrometers. However, a substantially curl-free or nearly flat configuration of this ACBC free imaging member does mean that it (a 2 inch by 10 inch cut piece of this member under unstrained/free standing condition) is not absolutely or completely flatness since it still exhibits about 16 inch diameter of curl-up curvature.

Plasticized CTL and plasticized ground strip are described in U.S. patent application Ser. Nos. 12/762,257; 12/782,671; and 12/216,151, the entire disclosures of which are hereby incorporated by reference.

Disclosure Imaging Member II

Figure 3:
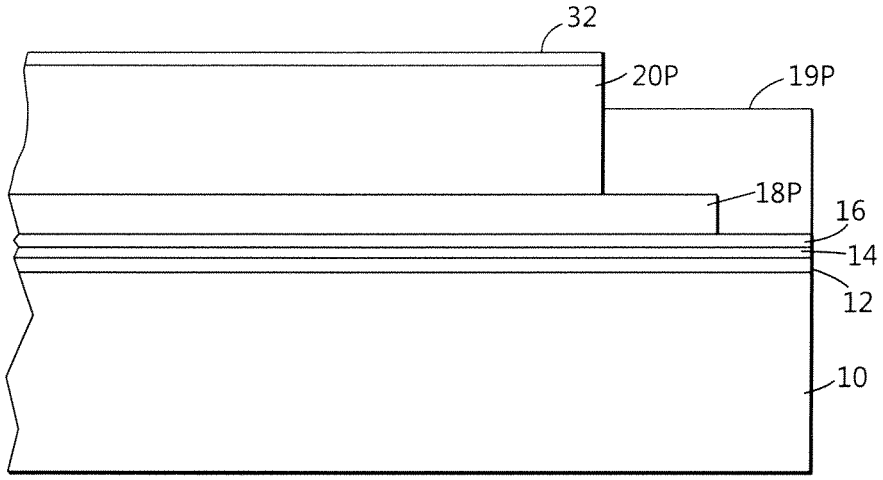
FIG. 3 is a schematic cross-sectional view of a second exemplary embodiment of a structurally simplified flexible imaging member belt containing a plasticized CTL to render the imaging member belt substantially curl-free configuration without the inclusion of an ACBC.

The plasticizer incorporation into the CTL 20P, CGL 18P, and the ground strip layer 19P of an ACBC free imaging member of FIG. 3 provides the benefits of rendering the imaging member belt curling suppression, effecting photoelectrical property stability, and prevention of early onset of fatigue CTL 20P cracking for achieving imaging member belt service life extension in the field. Nonetheless, the beneficial gains from elimination of the ACBC are negated and outweighed by the creation of undesirable problems, such as:

(1) Exposure of the substrate support 10 (without the protection of an ACBC) to the sliding contact friction against the components (such as belt support rollers and backer bars) of imaging member belt support module during xerographic imaging process causes development of early onset of substrate wear/scratch failure under a normal machine usage condition; that is the substrate support wear-off becomes debris and dust to contaminate machine cavity and impede electrophotographic imaging process which cut short the imaging member belt's service life in the field.

(2) The nearly flat or substantially flatness configuration of imaging member belt, without an ACBC, provided through plasticizing the CTL may not be adequately sufficient to meet the need of high volume electrophotographic imaging machines using a large imaging member belt (e.g., 10-pitch), because these machines require belt flatness for effecting proper imaging member belt dynamic cyclic function.

Thus, to capture and maintain all the benefits offered by utilizing plasticized CTL 20P, CGL 18P, and ground strip 19P in the imaging member web of FIG. 3 but without all the associated issues described above, an ACBC 3 including a cross-linked melamine formaldehyde may be formulated according to the present disclosure and then applied over the backside of substrate 10 for scratch/wear protection and rendering the imaging member with absolute flatness (FIG. 4) to meet the specifically stringent belt flatness need in those high volume machines.

Figure 4:
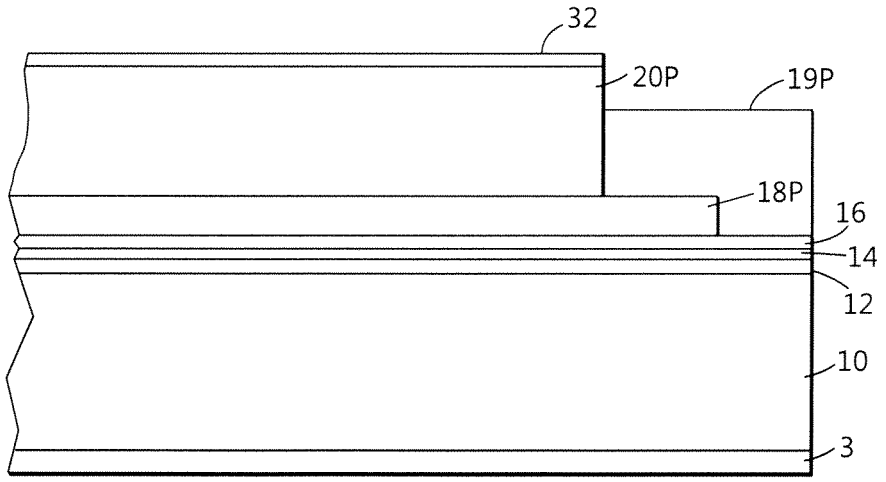
FIG. 4 is a schematic cross-sectional view of a second exemplary embodiment of a flexible imaging member belt containing a plasticized CTL and utilizing an ACBC prepared according to the description of present disclosure to effect perfect curl control and render absolute imaging member belt flatness.

Referring to FIG. 4, an exemplary embodiment of an imaging member having a plasticized CTL 20P, CGL 18P, and ground strip 19P and a disclosed crosslinked melamine formaldehyde ACBC 3 is prepared according the disclosure procedures to give absolute imaging member flatness configuration. The CTL 20P, CGL 18P, and ground strip 19P may be plasticized with a dially phthalate liquid, a dialkyl phthalate liquid, or mixtures thereof. The amount of plasticizer present in the CTL 20P is in the range of from about 5 percent weight to about 14 percent weight, from about 6 percent weight to about 12 percent weight, or from about 7 percent weight to about 9 percent weight, based on the total weight of each respective plasticized layer. The thickness of the plasticized CTL 20P is typically in the range of from about 10 to about 35 micrometers, from about 20 to about 30 micrometers, or about 29 micrometers. Therefore, in correspondence to the plasticized CTL 20P thickness, a melamine formaldehyde ACBC 3 thickness of from about 2 to about 8 micrometers, from about 3 to about 6 micrometers, or about 4 micrometers is required to balance each respective plasticized CTL 20P thickness described above for effecting absolute imaging member flatness control.

In one specific embodiment, the CTL 20P, CGL 18P, and ground strip 19P may be plasticized with 8% wt diethyl phthalate, based on the total weight of each respective plasticized layer. A 4-micrometer thick melamine formaldehyde ACBC 3 is employed to counteract a 29-micrometer thick and 8% diethyl phthalate plasticized CTL 20P to achieve complete imaging member curl control. The CTL 20P may be prepared to have a single, dual, or multiple layered design with every layer being plasticized. In still another specific embodiment, the plasticized CGL 18P and the CTL 20P may alternatively be combined and reformulated into a functional single plasticized layer to give a further structurally simplified imaging member out from that shown in FIG. 4.

The superior wear/scratch resistant and optically clear cross-linked melamine formaldehyde ACBC 3 in FIG. 4 of this disclosure (either being a binary material composition or triple material composition) is formulated according to the exact same formulation, procedures, and process as that described in the coating layer of ACBC 2 in FIG. 2, except that it is a thinner layer by using a dilute coating solution. The coating thickness of ACBC 3 being in the range of from about 2 to about 8 micrometers, or from about 3 to about 6 micrometers to render absolute imaging member flatness is directly depending on the thickness and amount of plasticizer incorporated into the CTL 20P.

In summary, the novel cross-linked melamine-formaldehyde ACBC layer, thus prepared according to each of the descriptions of this disclosure above, is a substantially continuous and uniform melamine-formaldehyde cross-linked coating layer and has excellent optical clarity, so that the residual voltage remaining after completion of a photoelectrical imaging process on the imaging member surface can conveniently be erased by radiation illumination directed from the back side of the imaging member belt through the entire ACBC thickness of the imaging member belt during electrophotographic imaging processes. For imaging member having a conventional CTL 20 of between about 10 and 35 micrometer thickness shown in FIG. 2, the disclosed ACBC 2 has a thickness of from about 8 to about 32 micrometers to provide complete curl control. However, the disclosed ACBC 3 should be from about 2 to about 8 micrometers or from about 3 to about 6 micrometers in thickness to counteract the effect of plasticized CTL/CGL/ground strip containing a plasticizer level in the range from about 5 percent weight to about 14 percent weight, from about 6 percent weight to about 12 percent weight, or from about 7 percent weight to about 9 percent weight (based on the total weight of each respective plasticized layer) to impact complete and total anti-curling control for achieving absolute imaging member flatness result shown in FIG. 4. In one particular exemplified embodiment, a 4-micrometer cross-linked melamine formaldehyde ACBC 3 is employed for imaging member (containing a 29-micrometer 8% wt diethyl phthalate plasticized CTL 20P) to give absolute and complete flatness control.

Typical solvent(s) used for melamine-formaldehyde ACBC layer coating solution preparation may include 1-methoxy-2-propanol, methyl n-amy ketone, methyl ethyl ketone, n-butyl Acetate, xylene, toluene, glycol ether acetates, and mixture thereof. Typical catalyst(s) used to activate the cross-linking reaction are selected from the group consisting of dibutyltin dilaurate, zinc octoate, p-touene sulfonic acid, and mixtures thereof. Generally, the weight ratio of the solid content of the coating solution to solvent is from about 0.2:10 to about 2:10, or from about 0.4:8 to about 4:8. Such weight ratio range of solid content to solvent content is satisfactory for use to give the variances of ACBC thickness. After application of the coating solution, the solvent in the wet coating ACBC may be removed by conventional techniques, such as, by vacuum in combination of heating, and the like.

The disclosed melamine-formaldehyde ACBC layer may be solution applied by any suitable conventional technique, such as, spraying, extrusion coating, dip coating, draw bar coating, gravure coating, silk screening, air knife coating, reverse roll coating, and the like with the solvent being removed after deposition of the coating layer by conventional techniques, such as, by vacuum in combination of heating, and the like. For the convenience of obtaining a thin ACBC coating layer of between about 2 and about 8 micrometers in thickness, the coating solution may be applied in the form of a dilute solution.

In electrophotographic reproducing or digital printing apparatuses using a flexible imaging member belt prepared to comprise a conventional CTL 20 or a plasticized CTL 20P (utilizing a melamine formaldehyde ACBC 2 or 3 of present disclosure), a light image is recorded in the form of an electrostatic latent image upon a photosensitive member and the latent image is subsequently rendered visible by the application of a developer mixture. The developer, having toner particles contained therein, is brought into contact with the electrostatic latent image to develop the image on the imaging member belt which has a charge-retentive surface. The developed toner image can then be transferred to a copy out-put substrate, such as paper, that receives the image via a transfer member.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The development of the presently disclosed embodiments will further be demonstrated in the non-limited Working Examples below. They are, therefore in all respects, to be considered as illustrative and not restrictive nor limited to the materials, conditions, process parameters, and the like recited herein. The scope of embodiments are being indicated by the appended claims rather than the foregoing description. All changes that come within the meaning of and range of equivalency of the claims are intended to be embraced therein.

The development of the presently disclosed embodiments will further be demonstrated in the non-limited Working Examples below. All proportions are by weight unless otherwise indicated.

Conventional Anticurl Back Coating Example

A conventional anti-curl back coating (ACBC) was prepared by combining 88.2 grams of poly(4,4'-isopropylidene diphenyl carbonate) (i.e., bisphenol A polycarbonate) resin (FPC170 from Mitsubishi Chemicals), 7.12 grams VITEL PE-200 copolyester (available from Bostik, Inc. Middleton, Mass.) and 1,071 grams of methylene chloride in a carboy container to form a coating solution containing 8.2 percent solids. The container was covered tightly and placed on a roll mill for about 24 hours until the polycarbonate and polyester were dissolved in the methylene chloride to form the ACBC solution. The ACBC solution was then applied onto a 3.5 mils (89 micrometers) thickness biaxially oriented polyethylene naphthalate substrate (PEN, KADALEX, available from DuPont Teijin Films) by following the standard hand coating procedures and dried to a maximum temperature of 125° C. in a forced air oven for two minutes to produce a dried ACBC with a thickness of 17 micrometers. The dried ACBC demonstrated good optical clarity and gave a 99.9% light transmittance in the visible light wavelength.

The bisphenol A polycarbonate used has a molecular formula shown below:

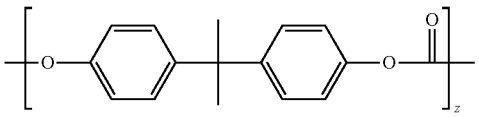

where z is about 470.

Disclosure Anticurl Back Coating Preparation (a) Binary material composition melamine formaldehyde ACBC formulation:

The formulation of the disclosed melamine-formaldehyde ACBC, having binary material compositions, was CYMEL 303LF a commercially available resin from Cytec CYMEL 303LF, as supplied from Cytec, was a methylolated melamine resin obtained by reacting melamine with formaldehyde to give methylolated melamines as described below:

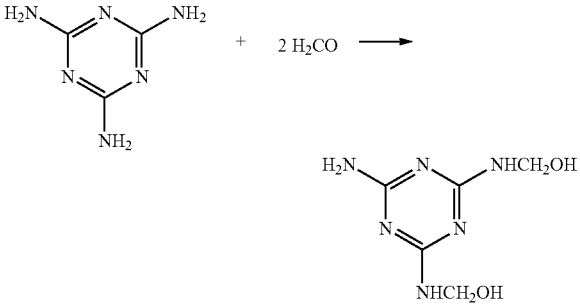

The methylolated melamine resin as commercially available was dissolved in Dowanol (from Dow Chemicals) along with 0.2 percent weight catalyst para-toluene sulfonic acid (NACURE XP357 from King Industries), based on the combined weight of the resin and catalyst to give the ACBC coating solution of this disclosure. The ACBC solution was applied over a 3.5 mils (89 micrometers) polyethylene naphthalate substrate by hand coating process and then dried at 130° C. for three minute in a forced air oven to initiate the chemical reaction among the methylolated melamine molecules and give a 3-dimensional crosslinked melamine formaldehyde ACBC network according to the following condensation/cross-linking reaction:

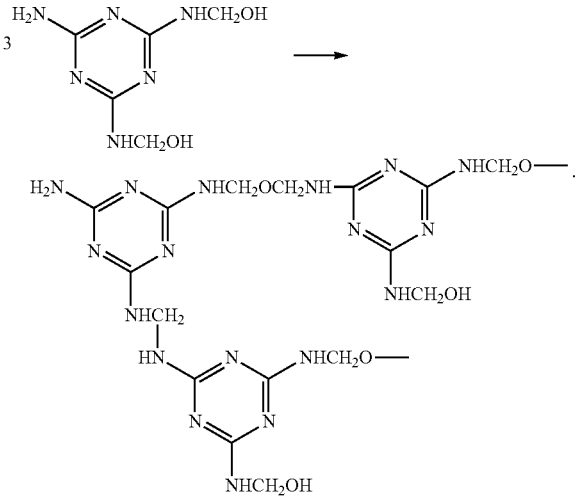

The dried ACBC of this disclosure, thus obtained, had optical clarity equivalent to that of the control ACBC.

(B) triple material composition melamine formaldehyde acbc formulation

The formulation of another melamine-formaldehyde ACBC of this disclosure was alternatively modified by the inclusion of a film forming hydroxyl functional acrylic polyol binder to give a cross-linked polyacrylate/melamine-formaldehyde layer variance of triple material composition comprising melamine, formaldehyde, and an acrylic polyol binder.

The formulation of the triple material ACBC was carried out as follows:

An ACBC pre-coating solution was first prepared to contain the following compositions:

| | |
|---|---|
| Binder: JONCRYL 587 | 8.44% wt |
| Cross-linking agent: CYMEL 303LF | 11.88% wt |
| Catalyst: NACURE XP357, 20% wt solid in solution | 1.80% wt |
| Solvent: DOWANOL | 77.88% wt |

It is noted that CYMEL 303LF (from Cytec) is a methylolated melamine (a reaction product of melamine and formaldehyde) to serve as cross-linking agent; JONCRYL 587 (a hydroxyl functional acrylic polyol from BASF) is the binder resin; and catalyst NACURE XP357 (from King Industries) is an ionic salt of p-toluene sulfonic acid compounded with a liquid organic amine in methanol. The NACURE XP357, as received from King Industries, contains 20 weight percent solid p-toluene sulfonic acid/amine ionic salts in 80 weight percent methanol solvent. All these components were mixed and dissolved with agitation in DOWANOL (a propylene glycol monomethyl ether solvent also known as 1-methoxy-2-propanol, available form Dow Chemicals) to give the pre-coating solution. The concentration of this pre-coating solution (20.68% wt solid) as prepared was further adjusted by adding it with DOWANOL to give a 16.7% wt solid final charge undercoat layer coating solution for application.

The prepared ACBC coating solution was likewise applied onto a 3.5 mils (89 micrometers) thickness polyethylene naphthalate substrate by following the standard hand coating procedures and dried to a maximum temperature of 130° C. in the forced air oven for three minutes to produce 20 micrometers dried disclosed ACBC thickness. Both of the resulting ACBCs as prepared had excellent optical clarity equals to that of the conventional ACBC control.

Example I

Control Imaging Member Preparation

A conventional prior art negatively charged flexible electrophotographic imaging member web (as that illustrated in FIG. 1 but without overcoat 32) was prepared by providing a 0.02 micrometer thick titanium layer 12 coated substrate of a biaxially oriented polyethylene naphthalate substrate 10 (PEN, available as KADALEX from DuPont Teijin Films) having a thickness of 3½ mils (89 micrometers), and extrusion coating the titanized KADALEX substrate with a blocking layer solution containing a mixture of 6.5 grams of gamma aminopropyltriethoxy silane, 39.4 grams of distilled water, 2.1 grams of acetic acid, 752.2 grams of 200 proof denatured alcohol and 200 grams of heptane. The resulting wet coating layer was allowed to dry for 5 minutes at 135° C. in a forced air oven to remove the solvents from the coating and effect the formation of a crosslinked silane blocking layer. The resulting blocking layer 14 had an average dry thickness of 0.04 micrometer as measured with an ellipsometer.

An adhesive interface layer 16 was then applied by extrusion coating to the blocking layer with a coating solution containing 0.16 percent by weight of ARDEL polyarylate, having a weight average molecular weight of about 54,000, available from Toyota Hsushu, Inc., based on the total weight of the solution in an 8:1:1 weight ratio of tetrahydrofuran/monochloro-benzene/methylene chloride solvent mixture. The adhesive interface layer was allowed to dry for 1 minute at 125° C. in a forced air oven. The resulting adhesive interface layer had a dry thickness of about 0.02 micrometer.

The adhesive interface layer was thereafter coated over with a charge generating layer. The charge generating layer (CGL 18) dispersion was prepared as described below:

To a 4 ounce glass bottle was added IUPILON 200, a polycarbonate of poly(4,4'-diphenyl)-1,1'-cyclohexane carbonate (PC-z 200, available from Mitsubishi Gas Chemical Corporation) (0.45 grams), and tetrahydrofuran (50 milliliters), followed by hydroxygallium phthalocyanine Type V (2.4 grams) and ⅛ inch (3.2 millimeters) diameter stainless steel shot (300 grams). The resulting mixture was placed on a ball mill for about 20 to about 24 hours to obtain a slurry. Subsequently, a solution of poly(4,4'-diphenyl-1,1'-cyclohexane carbonate) (2.25 grams) having a weight average molecular weight of 20,000 (PC-z 200) dissolved in tetrahydrofuran (46.1 grams) was added to the hydroxygallium phthalocyanine slurry. The resulting slurry was placed on a shaker for 10 minutes and thereafter coated onto the adhesive interface 16 by extrusion application process to form a layer having a wet thickness of 0.25 mil. A strip of about 10 millimeters wide along one edge of the substrate web stock bearing the blocking layer 14 and the adhesive layer 16 was deliberately left uncoated by the CGL 18 to facilitate adequate electrical contact by a ground strip layer to be applied later. The resulting CGL 18 containing poly(4,4'-diphenyl)-1,1'-cyclohexane carbonate, tetrahydrofuran and hydroxygallium phthalocyanine was dried at 125° C. for 2 minutes in a forced air oven to form a dry charge generating layer having a thickness of 0.4 micrometers.

This coated web stock was simultaneously coated over with a charge transport layer (CTL 20) and a ground strip layer 19 by co-extrusion of the coating materials. The CTL was prepared as described below:

To an amber glass bottle was added bisphenol A polycarbonate thermoplastic having an average molecular weight of about 120,000 (FPC 0170, commercially available from Mitsubishi Chemicals) and a charge transport compound of N,N'-diphenyl-N,N'-bis(3-methylphenyl)-1,1'-biphenyl-4,4'-diamine. The weight ratio of the bisphenol A polycarbonate thermoplastic and N,N'-diphenyl-N,N'-bis(3-methylphenyl)-1,1'-biphenyl-4,4'-diamine was 1:1. The resulting mixture was dissolved in methylene chloride such that the solid weight percent in methylene chloride was 15 percent by weight. Such mixture was applied on the CGL 18 by extrusion to form a coating which upon drying in a forced air oven gave a dry CTL 20 of 29 micrometers thick. The strip, about 10 millimeters wide, of the adhesive layer 16 left uncoated by the CGL 18, was coated with a ground strip layer 19 during the co-extrusion process. The ground strip layer coating mixture was prepared as described below:

To a carboy container was added 23.8 grams of bisphenol A polycarbonate resin (FPC 0170) and 332 grams methylene chloride, and methylene chloride (332 grams). The container was covered tightly and placed on a roll mill for about 24 hours until the polycarbonate was dissolved and gave a 7.9 percent by weight solution. The prepared solution was mixed for 15-30 minutes with about 94 grams of graphite dispersion solution (available as RW22790, from Acheson Colloids Company) to give ground strip layer coating solution. (Note: The graphite dispersion solution, RW22790 as commercially obtained, contained a 12.3 percent by weight solids including 9.41 parts by weight of graphite, 2.87 parts by weight of ethyl cellulose, and 87.7 parts by weight of solvent).

To effect homogeneous graphite dispersion, the resulting ground strip layer coating solution was then mixed with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the CTL solution, to the electrophotographic imaging member web to form an electrically conductive ground strip layer 19 having a dried thickness of about 19 micrometers.

The imaging member web stock containing all of the above layers was then passed through 125° C. in a forced air oven for 3 minutes to simultaneously dry both the CTL 20 and the ground strip 19. Since the CTL has a Young's Modulus of $3.5\times10^5$ psi ($2.4\times10^4$ Kg/cm$^2$) and a thermal contraction coefficient of $6.5\times10^{-5}$/° C. compared to the Young's Modulus of $5.5\times10^5$ psi ($3.8\times10^4$ Kg/cm$^2$) and thermal contraction coefficient of 1.8×° C. for the PEN substrate support 10, the CTL 20 was about 3.6 times greater in dimensional shrinkage than that of PEN substrate support. Therefore, the imaging member web if unrestrained at this point would curl upwardly into a 1½-inch tube.

To effect imaging member curl control, a conventional ACBC 1 was prepared by combining 88.2 grams of FPC 0170 bisphenol A polycarbonate resin, 7.12 grams VITEL PE-2200 copolyester (available from Bostik, Inc. Middleton, Mass.), and 1,071 grams of methylene chloride in a carboy container to form a coating solution containing 8.2 percent solids. The container was covered tightly and placed on a roll mill for about 24 hours until the polycarbonate and polyester were dissolved in methylene chloride to form an anti-curl back coating solution. The ACBC coating solution as prepared was then applied to the rear surface (side opposite to the charge generating layer and CTL) of the electrophotographic imaging member web by extrusion coating and dried to a maximum temperature of 125° C. in a forced air oven for about 3 minutes to produce a dried ACBC 1 having a thickness of 17 micrometers and flattening the imaging member.

Disclosure Imaging Member Preparation Example I

A negatively charged flexible electrophotographic imaging member web of FIG. 2 was prepared in the very same manners and material compositions as those disclosed in the above EXAMPLE I CONTROL IMAGING MEMBER PREPARATION, but with the exception that the conventional ACBC 1 was substituted by a triple material composition 20 micrometers cross-linked melamine formaldehyde ACBC 2 of this disclosure. The formulation of the disclosed ACBC 2 was prepared in the exact same procedures and materials compositions described in preceding triple material composition of DISCLOSURE ANTICURL BACK COATING PREPARATION to give a 20 micrometers dried cross-linked polyacrylate/melamine-formaldehyde ACBC 2 thickness for effecting absolute curl control. The resulting imaging member web thus obtained, having total flatness, is identical to the configuration shown in FIG. 2 but without the overcoat 32.

Example II

Control ACBC-Free Imaging Member Preparation

A control negatively charged flexible electrophotographic imaging member web (not shown) was prepared by using the exact same materials, compositions, and following identical procedures as described in the preceding EXAMPLE I CONTROL IMAGING MEMBER PREPARATION, but without the application of ACBC 1 while the CTL 20, CGL 18P, and the ground strip layer 19P were each plasticized by incorporation of 8% wt diethyl phthalate (DEP) in respective layer. The resulting ACBC-free imaging member web, having a plasticized CTL 20P, as obtained, is shown FIG. 3 but without overcoat 32. Even though a 2 inch by 10 inch cut piece of this ACBC free imaging member was unrestrained and left free standing, it was seen to have a substantially, nearly flat configuration with the exhibition of slightly upward curling of about 16 inches of diameter of curvature (references: U.S. Pat. No. 8,168,356 and U.S. Pat. No. 8,173,341). The plasticizer DEP (available from Sigma-Aldrich Company) selected for use to formulate CTL 20P has a boiling point of about 295° C. and a molecular formula shown below:

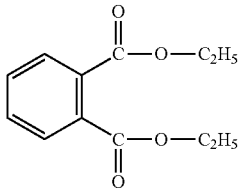

It is important to emphasize that even though the nearly flat imaging member configuration refers in particular to an ACBC-free flexible negatively charge imaging member prepared to have the CTL/CGL/ground strip incorporated with plasticizer in its material matrix to effect reduction of internal stress/strain build-up in the layers to minimize/suppress the extent of imaging member curling-up, but plasticizing the CTL/CGL/ground strip layer by 8 weight percent DEP incorporation only impact partial decease in the thermal dimensional contraction differential between the CTL and PEN (or PET) substrate, but without totally eliminating the curl. Therefore, the prepared imaging member web (though having a nearly flat configuration of exhibiting about 16 inch curl-up diameter of curvature) was still not giving a total belt flatness configuration to meet the stringent high volume machines requirement.

The resulting nearly flat ACBC-free imaging member as prepared was also used to serve as another imaging member Control.

Disclosure Imaging Member Preparation Example II

Although the EXAMPLE II CONTROL ACBC-FREE IMAGING MEMBER PREPARATION described above (to contain 8% wt DEP plasticized CTL/ground strip) was able to give the benefits of: a nearly flat imaging member web configuration, effect CTL fatigue cracking life extension, excellent long term photo-electrical cyclic stability, and plus copy print out quality improvement results in actual machine belt print test run; nonetheless without total elimination of imaging member curling, it is still yet not meet the stringent high volume machines absolute imaging member belt flatness requirement. Moreover, since the bottom PEN substrate support (without the protection of an ACBC) was exposed to numbers of belt module support rollers and backer bars mechanical friction interactions under a normal imaging member belt function in the high volume machine, pre-mature onset of PEN substrate wear/scratch failure had become a serious problem to out weight and negated the benefits to limit the ACBC-free imaging member's practical application value.

To resolve these short comings and issues while preserving/maintaining the photo-electrical stability and copy print quality improvement benefits, this very same negatively charged flexible ACBC-free electrophotographic imaging member web of the EXAMPLE II CONTROL ACBC-FREE IMAGING MEMBER PREPARATION, described above, was again prepared to have 8% wt DEP plasticized CTL 20P/ground strip layer 19P, but with the inclusion of a thin cross-linked melamine formaldehyde ACBC 3 of this disclosure prepared according to the exact descriptions detailed according to ACBC 2 in the preceding DISCLOSURE IMAGING MEMBER PREPARATION EXAMPLE I except by using a diluted coating solution. The resulting ACBC 3 coated over the PEN substrate support 10 was a thin coating layer of 4 micrometers in thickness to impact absolute imaging member flatness control and give a curl-free configuration as that shown in FIG. 4 but without having an overcoat 32.

Adhesion and Wear/Scratch Assessments

The imagine member webs of Disclosure Example I (having ACBC 2) and Disclosure Example II (having ACBC 3), prepared according to these preceding Working Example Disclosures, were first tested for the adhesion bond strength to the PEN substrate 10 by 180° peel strength measurement. They were found to not separate-able from the PEN substrate, since melamine formaldehyde is by itself an excellent adhesive.

The ACBC 2 and 3 of this disclosure was subsequently evaluated for wear resistance along the convention prior art ACBC control to determine and compare each respective mechanical function.

For ACBC wear resistance assessment, the imaging member web of the Disclosure Examples I and II and the conventional imaging member control of Example I were each again cut to give a size of 1 inch (2.54 cm) by 12 inches (30.48 cm) sample and then determined for its respective resistance to wear. Testing was conducted by means of a dynamic mechanical cycling device in which glass tubes were skidded across and on the test surface on each sample. More specifically, one end of each test sample was clamped to a stationary post and the sample was looped upwardly over three equally spaced horizontal glass tubes and then downwardly over a stationary guide tube through a generally inverted "U" shaped path with the free end of the sample secured to a weight which provided one pound per inch width tension on the sample. The surface of the test sample bearing the ACBC was faced downwardly so that it would periodically be brought into sliding mechanical contact with the glass tubes. The glass tubes had a diameter of one inch.

Each tube was secured at each end to an adjacent vertical surface of a pair of disks that were rotatable about a shaft connecting the centers of the disks. The glass tubes were parallel to and equidistant from each other and equidistant from the shaft connecting the centers of the disks. Although the disks were rotated about the shaft, each glass tube was rigidly secured to the disk to prevent rotation of the tubes around each individual tube axis. Thus, as the disk rotated about the shaft, two glass tubes were maintained at all times in sliding contact with the surface of the ACBC. The axis of each glass tube was positioned about 4 cm from the shaft. The direction of movement of the glass tubes along the charge transport layer surface was away from the weighted end of the sample toward the end clamped to the stationary post. Since there were three glass tubes in the test device, each complete rotation of the disk was equivalent to three wear cycles in which the surface of the test sample was in sliding mechanical contact with a single stationary support tube during the testing. The rotation of the spinning disk was adjusted to provide the equivalent of 11.3 inches (28.7 cm) per second tangential speed. The extent of the ACBC wear-off by the sliding contact friction against the glass tubes was measured using a permascope at the end of a 330,000 wear cycles test.

The ACBCs of these imaging member webs were evaluated further for each propensity to scratch damage by scratch resistant test. Scratch resistance was conducted out by sliding a 6 grams bad phonographic stylus over the ACBC surface at a rate of one centimeter per second. The depth of scratch damage of each ACBC caused by the stylus sliding mechanical action was then measured with a surface probe.

The results obtained for ACBC 180° peel-off strength and wear/scratch resistance are listed in Table 1 below:

TABLE 1

| Imaging Member | ACBC Type | Peel Strength (gms/cm) | Scratch Depth (microns) | Thickness Wear Off (microns) |
|---|---|---|---|---|
| Control | STD Polycarbonate | 92 | 0.5 | 9.4 |
| Disclosure Example I | Melamine Formaldehyde | Not peel | 0 | About 0.32 |
| Disclosure Example II | Same | Not Peel | 0 | About 0.32 |

Table 1 showed that the electrophotographic imaging member containing the disclosed ACBC formulated to comprise cross-linked melamine formaldehyde gave infinite adhesion bonding strength to the PEN substrate of being not separate-able, because melamine formaldehyde is by itself a super adhesive. Very importantly, the wear and scratch resistance of the two ACBCs of Disclosure Examples I and II were superb in comparison to the conventional prior art ACBC of the imaging member control.

In recapitulation, the present embodiments provide a physically/mechanically robust cross-linked formaldehyde ACBC formulation, prepared according to the descriptions of the present disclosure, for practical application in specific flexible imaging member which designed to contain either a conventional CTL or a plasticized CTL re-design. The resulting ACBC formulation, as prepared, had uniform coating thickness and also provided enhanced physical and mechanical properties such as: scratch/wear resistance; excellent adhesion bonding to the support substrate; good optical clarity/transparency to allow the convenient of imaging member belt back erase by radiant light; and very importantly, excellent curling control to meet imaging member absolute belt flatness requirement of all the high volume machines.

Therefore, the experimental results obtained and demonstrated in all the above embodiments had indicated that conventional prior art flexible imaging member belt prepared to include a cross-linked melamine formaldehyde ACBC of this disclosure for STD ACBC replacement could provide effective imaging member curl control and improve physical/mechanical function for achieving imaging member belt service extension in the field.

Of particular break-through is the demonstration that imaging member employ a plasticized CTL for curl suppression did indeed require the inclusion of a cross-linked melamine formaldehyde ACBC formulation of the present disclosure to provide: (a) protection of the substrate support against pre-mature onset of back side of the belt wear failure under dynamic machine imaging member belt cycling condition in the field, (b) preservation/maintain the photo-electrical stability and copy print-out quality improvement benefits offered by the plasticized CTL, and very importantly (c) render imaging member flatness to meet stringent machine belt flatness requirement.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents as would fall within the true scope and spirit of embodiments herein.

The invention claimed is:

1. A flexible electrophotographic imaging member comprising:

a substrate;

a charge generating layer disposed on the substrate;

a charge transport layer disposed on the charge generating layer; and an anticurl back coating layer having a three-dimensional cross-linked network of bonds disposed on the substrate on a side opposite to the charge transport layer, wherein the anticurl back coating layer comprises crosslinked melamine formaldehyde, wherein the melamine formaldehyde is produced from the reaction between melamine and formaldehyde to give methylolated melamine having the formula

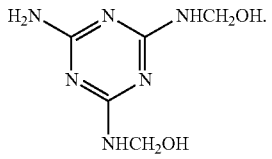

and further wherein the formed methylolated melamine subsequently reacts among itself by a condensation reaction.

2. The flexible electrophotographic imaging member of claim 1, wherein the anticurl back coating layer is formed from a coating solution comprising melamine, formaldehyde, a particle dispersion and a solvent, and further wherein the anticurl back coating layer comprises a cross-linked network of bonds formed from a reaction between the melamine and formaldehyde at an elevated temperature to give methylolated melamine and further wherein the formed methylolated melamine subsequently reacts among itself by a condensation reaction.

3. The flexible electrophotographic imaging member of claim 2, wherein the mole ratio of melamine to formaldehyde is from about 1:1 to about 1:3.

4. The flexible electrophotographic imaging member of claim 2, wherein the condensation reaction is represented by the following:

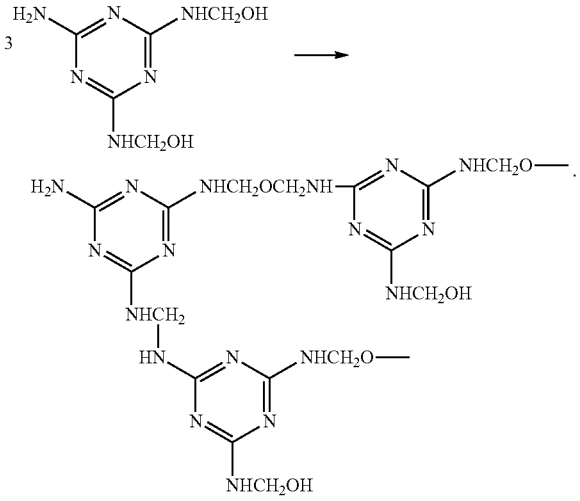

5. The flexible electrophotographic imaging member of claim 2, wherein the condensation reaction is carried out at the elevated temperature of from about 120° C. to about 130° C.

6. The flexible electrophotographic imaging member of claim 2, wherein the condensation reaction is carried out in the presence of a catalyst.

7. The flexible electrophotographic imaging member of claim 6, wherein the catalyst is selected from the group consisting of dibutyltin dilaurate, zinc octoate, para-touene sulfonic acid, and mixtures thereof.

8. The flexible electrophotographic imaging member of claim 2, wherein the solvent is selected from the group consisting of alcohol, 1-methoxy-2-propanol, methyl n-amy ketone, methyl ethyl ketone, n-butyl acetate, xylene, toluene, glycol ether acetates, and mixtures thereof.

9. The flexible electrophotographic imaging member of claim 2, wherein the weight ratio of a solid content of the coating solution to the solvent is from about 0.2:10 to about 2:10.

10. The flexible electrophotographic imaging member of claim 2, wherein the coating solution further comprises a polyhydroxyalkyl arcrylate binder.

11. The flexible electrophotographic imaging member of claim 10, wherein the polyhydroxyalkyl arcrylate binder is selected from the group consisting of polyhydroxymethyl acrylate, polyhydroxyethyl acrylate, polyhydroxyproyl acrylate, polyhydroxybutyl acrylate, polyhydroxypentyl acrylate, polyhydroxyhexyl acrylate, and mixtures thereof.

12. The flexible electrophotographic imaging member of claim 1, wherein the charge transport layer comprises a plasticizer.

13. The flexible electrophotographic imaging member of claim 12, wherein the plasticizer is selected from the group consisting of a dially phthalate liquid, a dialkyl phthalate liquid, or mixtures thereof.

14. The flexible electrophotographic imaging member of claim 12, wherein the plasticizer is present in the charge transport layer in an amount of from about 3 to about 15 weight percent based on the total weight of the charge transport layer.

15. The flexible electrophotographic imaging member of claim 1, wherein the anticurl back coating layer has a thickness from about 3 to about 32 micrometers.

16. A flexible electrophotographic imaging member comprising:

a substrate;

a charge generating layer disposed on the substrate;

a charge transport layer disposed on the charge generating layer, the charge transport layer comprising a plasticizer; and an anticurl back coating layer having a three-dimensional cross-linked network of bonds disposed on the substrate on a side opposite to the charge transport layer, wherein the anticurl back coating layer is formed from a coating solution comprising a polyhydroxyalkyl arcrylate binder, a methylolated melamine having the formula

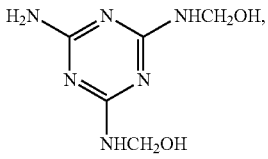

a catalyst, and a solvent, and further wherein the cross-linked network of bonds is formed from the reaction between the methylolated melamine and the polyhydroxyalkyl arcrylate binder to obtain a cross-linked polyacrylate/melamine-formaldehyde anticurl back coating layer.

17. The flexible electrophotographic imaging member of claim 16, wherein the plasticizer is selected from the group consisting of a dially phthalate liquid, an dialkyl phthalate liquid, 3-(trifluoromethyl)phenylacetone, or mixtures thereof.

18. The flexible electrophotographic imaging member of claim 17, wherein the plasticizer comprises diethyl phthalate.

19. The flexible electrophotographic imaging member of claim 16, wherein the anticurl back coating layer has a thickness from about 2 to about 8 micrometers.

20. An image forming apparatus for forming images on a recording medium comprising:

a) an electrophotographic imaging member having a charge retentive-surface for receiving an electrostatic latent image thereon, wherein the imaging member comprises:

a substrate;

a charge generating layer disposed on the substrate;

a charge transport layer disposed on the charge generating layer; and an anticurl back coating layer having a three-dimensional cross-linked network of bonds disposed on the substrate on a side opposite to the charge transport layer, wherein the anticurl back coating layer comprises crosslinked melamine formaldehyde, wherein the melamine formaldehyde is produced from the reaction between melamine and formaldehyde to give methylolated melamine having the formula

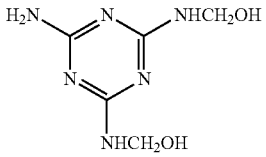

and further wherein the formed methylolated melamine subsequently reacts among itself by a condensation reaction;

b) a development component adjacent to the charge-retentive surface for applying a developer material to the charge-retentive surface to develop the electrostatic latent image to form a developed image on the charge-retentive surface;

c) a transfer component adjacent to the charge-retentive surface for transferring the developed image from the charge-retentive surface to a copy substrate; and d) a fusing component adjacent to the copy substrate for fusing the developed image to the copy substrate.

* * * * *